US005938036A

United States Patent [19]

Villemure

[11] Patent Number: 5,938,036

[45] Date of Patent: Aug. 17, 1999

[54] ASSEMBLY OF PACKAGED REAMS AND METHOD THEREFOR

[75] Inventor: Alain Villemure, St. Lambert, Canada

[73] Assignee: Domtar Inc., Quebec, Canada

[21] Appl. No.: 09/154,934

[22] Filed: Sep. 17, 1998

Related U.S. Application Data

[60] Continuation of application No. 08/820,148, Mar. 19, 1997, abandoned, which is a division of application No. 08/576,786, Dec. 21, 1995, Pat. No. 5,647,191.

[51] Int. Cl.[6] ..... B65D 19/00

[52] U.S. Cl. ..... 206/596; 206/774; 206/597; 206/600

[58] Field of Search ..... 206/736, 722, 206/774, 586, 386, 215, 499, 497, 813, 597

[56] References Cited

U.S. PATENT DOCUMENTS

| | | | |
|---|---|---|---|
| 3,399,762 | 9/1968 | Potter | 206/215 |
| 4,292,901 | 10/1981 | Cox | 108/55.1 |
| 4,365,710 | 12/1982 | Swanson | 206/386 |
| 4,919,270 | 4/1990 | Govang et al. | 206/597 |
| 4,946,042 | 8/1990 | Ferreri et al. | 206/736 |
| 5,348,147 | 9/1994 | Gottfreid | 206/215 |

*Primary Examiner*—Paul T. Sewell
*Assistant Examiner*—Nhan T. Lam
*Attorney, Agent, or Firm*—Bachman & LaPointe, P.C.

[57] ABSTRACT

An assembly of packaged reams of paper sheets for point of purchase or distribution display has a plurality of stacked layers of the packaged reams in contacting relationship; an adhesive film between at least some contacting upper and lower packaged reams adheres the packaged reams together; the adhesive has a high strength component in a first lateral direction of the film effective to hinder relative horizontal movement of the contacting upper and lower packaged reams having the adhesive film therebetween, and a weak strength component in a second direction perpendicular to the lateral direction such that the contacting upper and lower packaged reams are readily separated by a displacing force in the second direction; a flexible protective sheet is wrapped about the stacked layers; the assembly optionally includes a tubular sleeve applied over the stacked layers at the point of purchase or distribution, after removal of the protective sheet, a removable panel in the tubular sleeve exposes the packaged reams whereby individual packaged reams may be readily removed from the top of the stack by a light upward lifting force applied to a packaged ream of an uppermost layer of the stack.

10 Claims, 3 Drawing Sheets

ASSEMBLY OF PACKAGED REAMS AND METHOD THEREFOR

CROSS REFERENCE TO RELATED APPLICATIONS

This application is a continuation of U.S. patent application Ser. No. 08/820,148, filed Mar. 19, 1997 now abandoned, which in turn is a divisional of U.S. patent application Ser. No. 08/576,786, filed Dec. 21, 1995, now U.S. Pat. No. 5,647,191.

BACKGROUND OF THE INVENTION a) Field of the Invention

This invention relates to a method of producing an assembly of reams of paper sheets for point of distribution display of the reams, and to such an assembly.

b) Description of Prior Art

Paper sheets for use in typing, photocopy, telefacsimile and the like are typically packed in reams in a paper wrapping in which each ream contains 50 sheets in a stack. The packaged reams are typically packed in cardboard cartons or boxes which hold 10 reams; typically each carton contains two adjacent piles of packaged reams, each pile being formed of 5 packaged reams.

The cartons are closed and sealed and stacked on a pallet to form five layers of cartons, each layer having nine cartons in a compact side-by-side relationship of 3 by 3 cartons; typically adjacent layers of cartons are displaced laterally by 90° relative to the cartons of an adjacent layer. The assembly of boxes is wrapped with stretch film wrapping. The cartons within such a wrapped unit are adhered together.

These wrapped units are suitable for users of large amounts of paper sheets, however, unwrapping at the site of distribution is inconvenient and requires a person of good strength to remove individual cartons, each containing 10 reams from the unit. The sealed carton must then be opened to obtain a single packaged ream.

Access to individual packaged reams in the wrapped unit is thus limited and extensive disassembly of the wrapped unit and unpacking of cartons is required to make the individual packaged reams readily accessible. The wrapped units also require heavy packaging in the form of the cartons, which results in a bulky waste packaging.

These wrapped units are inappropriate for display and distribution of individual packaged reams such as might be purchased by small offices or for the home.

SUMMARY OF THE INVENTION

It is an object of this invention to provide a method of producing an assembly of reams of paper sheets for point of distribution display of the reams.

It is a further object of this invention to provide such a method whereby individual reams are displayed and accessible, while avoiding the waste of cartons.

It is still a further object of this invention to provide an assembly of reams of paper sheets for point of distribution display of the reams.

In accordance with one aspect of the invention there is provided a method of producing an assembly of reams of paper sheets for point of distribution display of the reams comprising: i) packaging a multiplicity of paper sheets to form a plurality of packaged reams, ii) feeding the packaged reams onto a support in aligned contacting relationship to form stacked layers on said support, each layer comprising packaged reams in side-by-side relationship, iii) applying an adhesive film to a horizontal outer surface of at least some of said packaged reams, said adhesive having a high strength component in a first lateral direction of such film effective to hinder relative horizontal movement of contacting upper and lower packaged reams having a said adhesive film therebetween, and a low strength component in a second direction perpendicular to said lateral direction such that the contacting upper and lower packaged reams are readily separated by a displacing force in said second direction, and iv) wrapping a flexible protection sheet about the stacked layers.

In accordance with another aspect of the invention there is provided an assembly of reams of paper sheets for point-of-distribution display of the reams comprising: a plurality of stacked layers of packaged reams in aligned contacting relationship, each packaged ream containing a multiplicity of paper sheets, each layer comprising packaged reams in side-by-side relationship, a film of adhesive between at least some contacting upper and lower packaged reams of said layers, said adhesive having a high strength component in a first lateral direction of said film effective to hinder relative horizontal movement of the contacting upper and lower packaged reams having the adhesive film therebetween, and a low strength component in a second direction perpendicular to said lateral direction such that contacting upper and lower packaged reams are readily separated by a displacing force in said second direction, and a flexible protective sheet wrapped about said stacked layers.

In accordance with yet another aspect of the invention there is provided a display assembly of reams of paper sheets for point-of-distribution of the reams comprising a plurality of stacked layers of packaged reams in aligned contacting relationship, each packaged ream containing a multiplicity of paper sheets, each layer comprising packaged reams in side-by-side relationship, a film of adhesive between at least some contacting upper and lower packaged reams of said layers, said adhesive having a high strength component in a first lateral direction of said film effective to hinder relative horizontal movement of the contacting upper and lower packaged reams having the adhesive film therebetween, and a low strength component in a second direction perpendicular to said lateral direction such that contacting upper and lower packaged reams are readily separated by a displacing force in said second direction, and a rectangular tubular sleeve surrounding said plurality of stacked layers with rectangular walls of the sleeve in opposed adjacent relationship with the stacked layers, said sleeve having a removable panel in a front side wall, such that removal of the removable panel exposes the stacked layers and provides display of and ready access to individual packaged reams.

DESCRIPTION OF PREFERRED EMBODIMENTS WITH REFERENCE TO THE DRAWINGS

Figure 1:
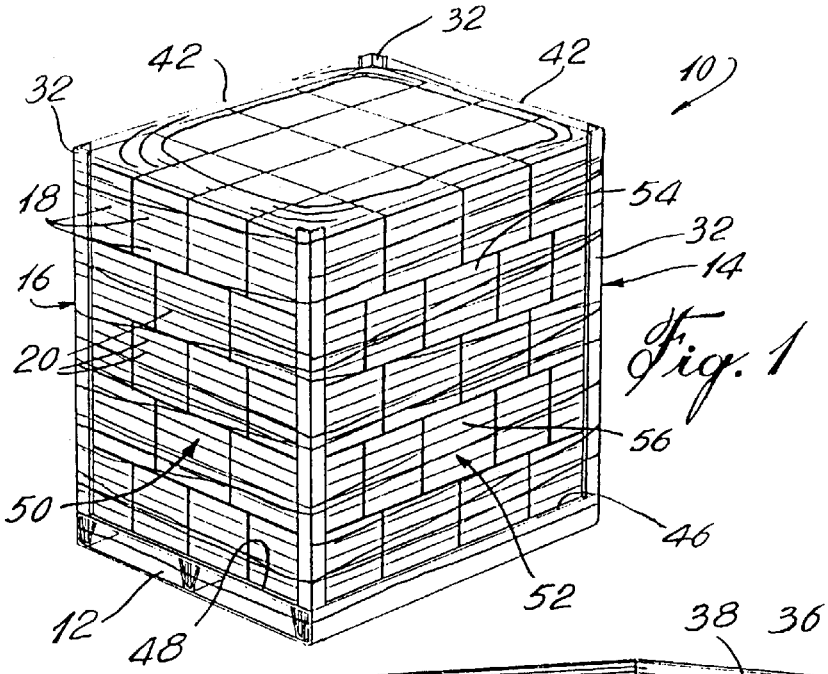
FIG. 1 is a perspective view of an assembly of the invention in the form of a sheet wrapped unit which is shown supported on a pallet.

With further reference to FIG. 1, an assembly 10 of the invention is supported on a pallet 12.

Assembly 10 more particularly comprises a sheet wrapped unit 14 having a tower 16 of individual packaged reams 18. The packaged reams 18 are in side-by-side contacting relationship in rows or layers 20 and the rows or layers 20 are stacked one on top of the other to form first stacks 22, 24 and 26 and second stacks 28 and 30.

The packaged reams 18 in the stacks 22, 24 and 26 are aligned in the same direction as viewed from a front face 50 of tower 16. The packaged reams 18 in the stacks 28 and 30 are likewise aligned in the same direction, but the stacks 28 and 30 are in alternating relationship with the stacks 22, 24 and 26 as viewed from the afore-mentioned front face 50, with the packaged reams 18 of the stacks 28 and 30 being displaced laterally at 90° to the packaged reams 18 of the stacks 22, 24 and 26.

As can be seen from side face 52 of tower 16, internal columns 54 and 56 of packaged reams 18 in stacks 28 and 30 are disposed so as to be aligned with the packaged reams of the adjacent stacks 22, 24 and 26.

This arrangement results in staggering of packaged reams 18 at the interfaces of the stacks 22, 24 and 26 with the stacks 28 and 30 and provides stability to the tower 16, as compared with aligning all the packaged reams 18 in the same direction throughout tower 16.

An inner transparent flexible, protective sheet 35 is applied, as by wrapping, about the outer faces, including faces 50 and 52, of tower 16 and a similar transparent, flexible protective sheet (not shown) is applied over a top face 54 of tower 16. The sheet 35 may be of the stretch wrap type commonly employed in the packaging industry.

L-shaped elongate corner supports 32 are applied to the vertical corners of the tower 16 and an outer transparent, flexible, protective sheet 34 similar to sheet 35 is applied, as by wrapping or winding, about the tower 16 and corner supports 32 to form the sheet wrapped unit 14. The pallet 12 which supports assembly 10, has a smooth horizontal support surface 46 and suitably has an anti-slip coating 48. The smooth surface 46 is suitably formed from a smooth cardboard. The smooth surface 46 prevents damage to the packaged reams 18 which might occur employing rough wooden pallets.

The pallet 12 is suitably fabricated from cardboard and is recyclable. Such pallets are known in the packaging industry and one such pallet is available under the Trade Mark PAYLOAD from Domtar Inc. of Montreal, Canada. Similar pallets are available from Jefferson-Smurfit Inc. in the U.S.A.

Reference is made to U.S. Pat. Nos. 5,427,034 and 5,406,892 both of Jefferson Smurfit Corporation, which describe paperboard pallets, the teachings of these U.S. Patents being incorporated herein by reference.

As an alternative, a wooden pallet may be employed if this is provided with a smooth horizontal surface; for example, a paperboard sheet or layer, or a polymer or rubber sheet or layer secured to the top face of the wooden pallet might provide a suitable smooth surface. It is, of course, within the skill of persons in the art to fabricate a wooden pallet with a smooth wooden support face.

Figure 2:
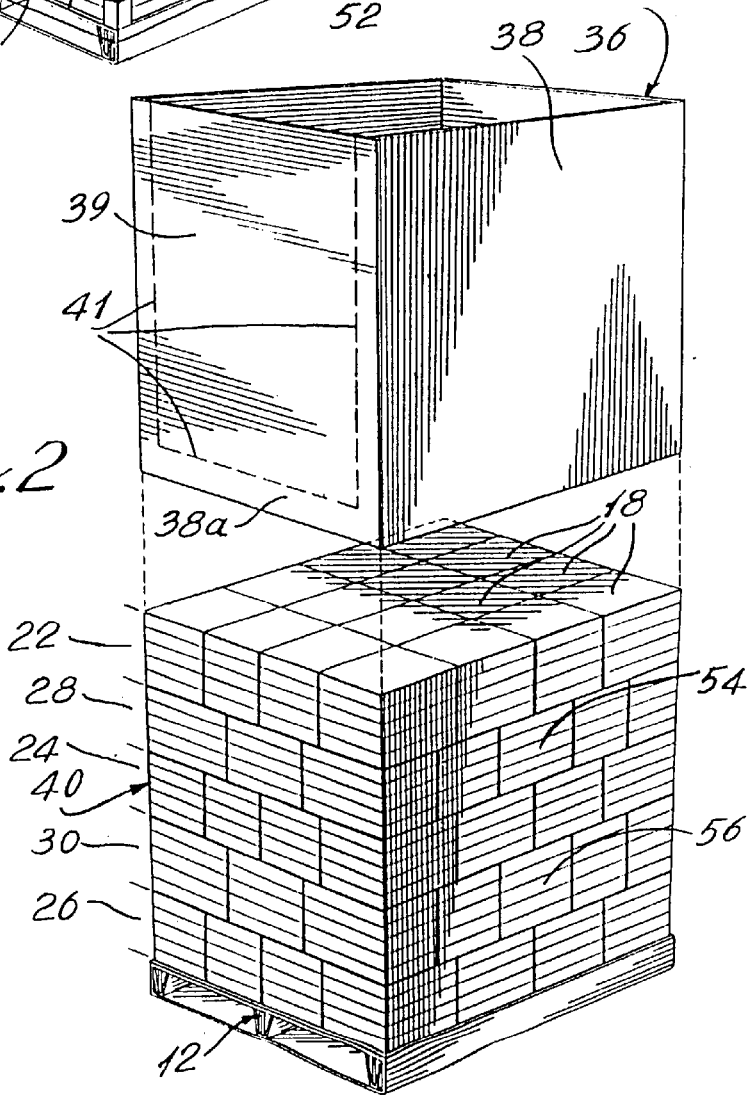
FIG. 2 shows the unit of FIG. 1 with the sheet wrapping and corner support members removed and a sleeve about to be applied to the unit.

With further reference to FIG. 2, the assembly 10 on pallet 12 of FIG. 1 is shown with the sheet wrap 34 and 35 and the corner supports 32 removed and a tubular sleeve 36 disposed to slide onto and about tower 16. Tubular sleeve 36 has rectangular walls 38 with a removable panel 39 in a front wall 38*a*. Panel 39 is defined by a perforation line 41.

Tower 16 essentially defines a rectangular prism 40.

Figure 3:
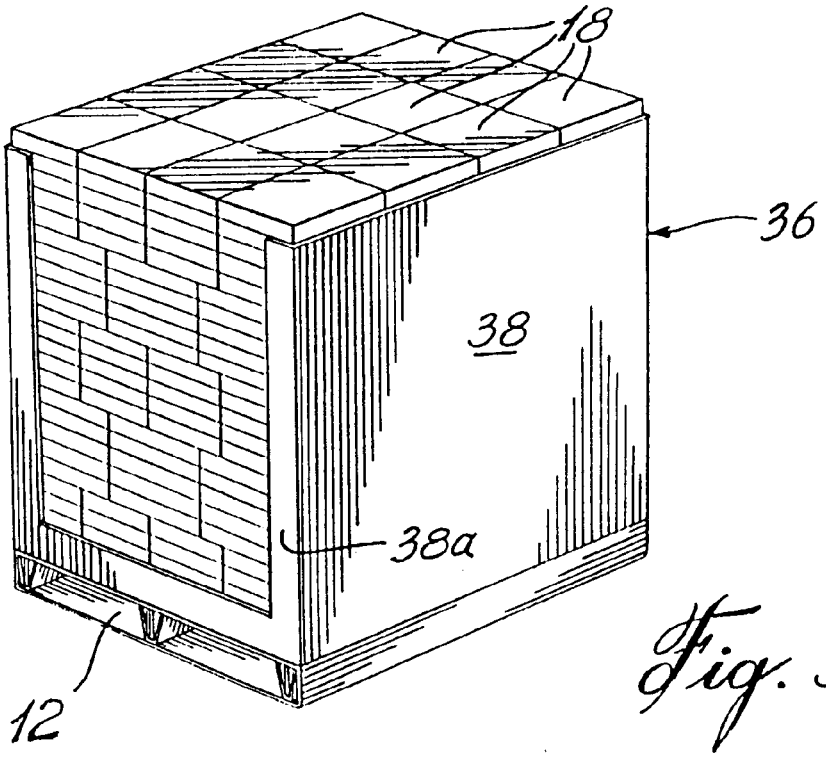
FIG. 3 shows a display unit derived from the unit of FIG. 2 with the sleeve applied and go removable panel removed.

With further reference to FIG. 3, there is shown the rectangular prism 40 of FIG. 2 on pallet 12 with sleeve 36 thereon and panel 39 removed; the rectangular side walls 38 of the sleeve 36 are in opposed, adjacent relationship with the side walls of the prism 40.

Figure 4:
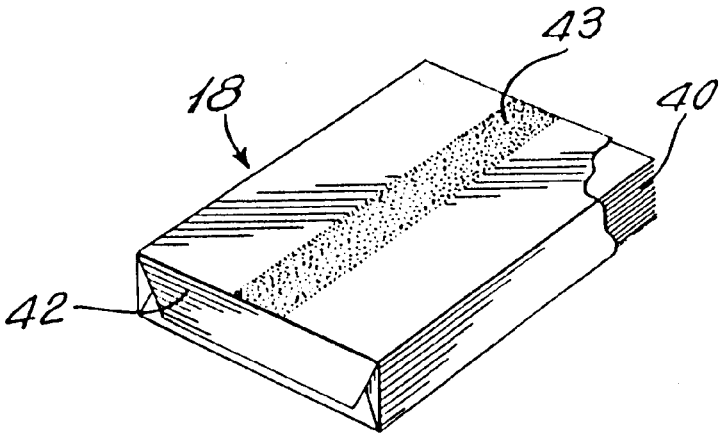
FIG. 4 is a perspective view of a packaged ream having a film of adhesive applied thereto.

With further reference to FIG. 4, there is shown a packaged ream 18 having a paper wrapping 42 in conventional manner, one corner of the wrapping 42 having been removed to show the multiplicity of paper sheets 44. A film 43 of adhesive is shown applied to paper wrapping 42 on an upper horizontal face of the packaged ream 18.

The stacks 22, 24, 26, 28 and 30 suitably contain 4 to 6 and preferably 5 layers of packaged reams 18. In particular there are at least two stacks of each type in alternating relationship.

Figure 5:
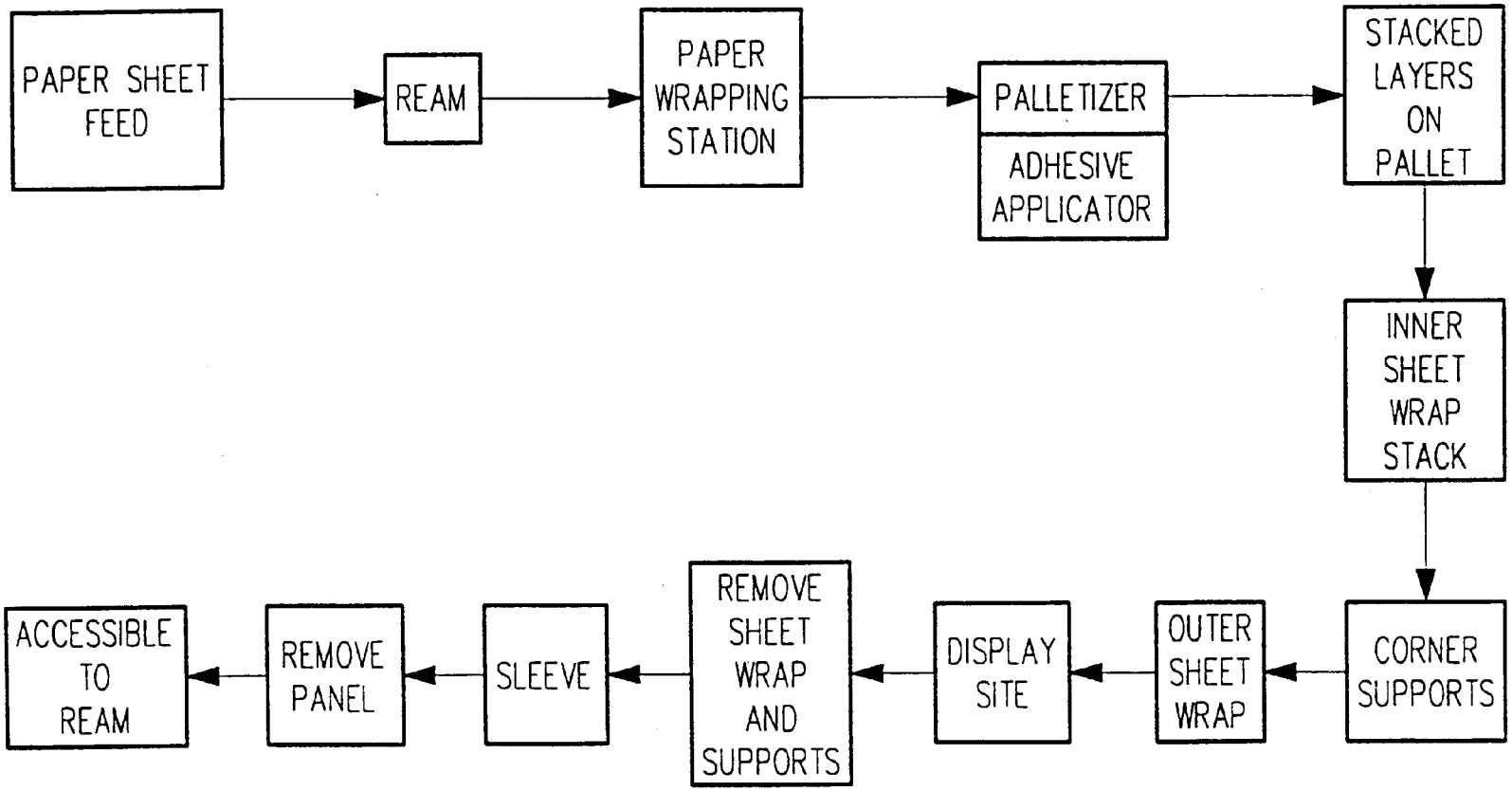
FIG. 5 is a flow sheet illustrating manufacture of the wrapped unit of FIG. 1 and its conversion at a distribution site to a display unit of FIG. 3.

The manufacture of assembly 10, as illustrated in FIG. 1, and its conversion to the display unit of FIG. 3 is illustrated in flow sheet form in FIG. 5.

Paper sheets are fed from a paper sheet feed to form a ream comprising a multiplicity of the sheets, typically 50 sheets. Each ream is wrapped with paper wrapping at a paper wrapping station and is delivered to a palletizer having associated therewith an adhesive applicator.

The palletizer delivers individual packaged reams in layer formation as described hereinbefore on a pallet. The delivery of the packaged reams to the pallet may typically be achieved by a drop feed palletizer such as the palletizer of the ALVEY 880 series of Pinnacle Automation Company of St. Louis, Mo., U.S.A., however, other palletizers widely employed in industry for feeding a packaged product to a pallet can be employed and the invention does not reside in the nature of the palletizer, suitable palletizers being commercially available as well understood in the packaging industry.

Reference is made to U.S. Pat. No. 4,109,781 of Alvey, Inc., the teachings of which are incorporated herein by reference, and which describe a palletizer having a device for changing the direction of feed by 90°.

During the course of the palletizing operation an adhesive is applied such as by spray to form a film of adhesive on an upper face of the packaged reams. It is not necessary that the adhesive be applied to all packaged reams, however, it may be more convenient to apply the adhesive to all packaged reams rather than selected reams only.

The adhesive is of a type known in the packaging field and has the characteristic that it has a significant or high strength component in a first lateral direction of the film, and this strength is effective to hinder or prevent relative horizontal movement of contacting upper and lower packaged reams having the adhesive film on the upper face of the a lower packaged ream. This provides stability in the stacks of packaged reams on the pallet. On the other hand, the adhesive has the further characteristic that it has a low or weak strength component in a second direction perpendicular to the lateral direction, i.e., essentially the vertical direction, such that the contacting upper and lower packaged reams are readily separated by a displacing force in such vertical direction. Thus application of a light lifting force to an upper packaged ream displace it from the adjacent lower packaged ream to which it is adhered, without disturbing the location of packaged reams located underneath the lower packaged ream of the pair.

The palletizer feeds the reams to form the differently aligned stacks as described hereinbefore whereby a staggered relationship is achieved between adjacent stacks.

The staggered relationship in conjunction with the adhesive results in a stable tower formation, even though the tower is formed of a large number of small stacked units, i.e., the packaged reams.

A sheet wrap is applied at an inner sheet wrap station about the side faces of the tower of packaged reams and over the top face and the four corner supports are applied to the corners of the resulting wrapped tower. Thereafter an outer sheet wrap is applied at an outer sheet wrap station, about the wrapped tower and corner supports. Typically there may be several windings of the sheet wrap in order to protect the packaged reams during shipping and related handling.

In this form the assembly 10 on its pallet is shipped to a distribution site, which may be the office of a large consumer who purchases the full assembly, or to a site of purchase such as a store which sells individual packaged reams for small offices or home use. In either case the assembly is readily converted to a display unit of the packaged reams, from which individual packaged reams can be easily removed by a user in an office, or a purchaser at a store.

At the display site the outer wrapping is removed. This can be achieved by applying a blade along the wrapping at one of the corner posts and stripping the wrapping away. Thereafter the corner supports are removed and the inner wrapping is similarly stripped away.

At this point the tower of packaged reams is fully exposed and supported on the pallet. The assembly is provided with the tubular rectangular sleeve which is provided in a folded condition. The sleeve is especially useful when the tower of packaged reams is located in a store for sale of individual packaged reams. In such case the sleeve is slid over the tower of packaged reams and the removable panel is removed at the perforation to expose the packaged reams at at least one face of the tower. It will be understood that the tubular sleeve may include a second removable panel in another wall of the sleeve in opposed relationship with the wall having the first removable panel, or indeed in three or four walls of the sleeve to provide multiple points of access to the packaged reams.

Preferably, however, the sleeve will have not more than two opposed removable panels and preferably will have only one removable panel. The sleeve provides added stability for the tower of packaged reams and guards against dislodgment of individual packaged reams or layers of the reams resulting from impact by users or shoppers, for example, impact with shopping carts. At the same time the full walls of the sleeve provide protection for the packaged reams against damage which might otherwise result from even mild impact with shopping carts or the like. The full walls also provide a display surface for information and advertising which can be personalized for particular users or distributors.

A particular adhesive for use in the invention and which has a high strength in a first lateral direction and a weak strength in a direction perpendicular to the lateral direction is that available under the Trade Mark LOCK 'N POP, from Uni-Lock Systems Division of Key Tech Corp., N.J., U.S.A.; published parameters of this adhesive include that it has a boiling point of 212° F., a pH of 9.8, a specific gravity of 1.01, and that it is highly soluble in water and is a white milky fluid.

A variation of the structure described in FIG. 1 employs a lid or cap fitted on the top side of assembly 10, either underneath or over one or both of the protective sheets 34 and 35. A further variation employs strapping, for example, strong plastic bands applied fully about the assembly 10, vertically and around the pallet 12 and the top side of the assembly, and over the lid or cap if employed. The lid or cap and the strapping improve the stability of the assembly 10 during transport.

The invention has been described with reference to particular and preferred embodiments, however, it will be understood that numerous variants of the specific embodiments will be apparent to persons in the art, and are considered to be within the scope of the claims herein.

I claim:

1. As assembly of reams of paper sheets for point of distribution display of the reams and ease of access to individual displayed reams comprising:

a plurality of displayed stacked layers of packaged reams in aligned contacting relationship, each packaged ream containing a multiplicity of paper sheets in a paper wrapping, each displayed layer comprising displayed packaged reams in side-by-side relationship, said displayed stacked layers forming a displayed tower of the displayed packaged reams, said displayed tower comprising a plurality of first stack units and a plurality of second stack units of said reams, said first and second stack units being in a displayed alternating relationship, said packaged reams of said second stack units being displaced laterally at 90° to said first stack units, said displayed tower defining a rectangular prism, a film of adhesive between at least some contacting upper and lower packaged reams of said displayed layers, said adhesive having a high strength component in a first lateral direction of said film effective to hinder relative horizontal movement of the contacting upper and lower packaged reams having the adhesive film therebetween, and a low strength component in a second direction perpendicular to said lateral direction such that contacting upper and lower packaged reams are readily separated by a displacing force in said second direction, and a flexible protective sheet wrapped about said displayed stacked layers.

2. An assembly according to claim 1, further including an L-shaped, elongate corner support member in engagement with each elongate, vertical corner of the prism.

3. An assembly according to claim 2, wherein said flexible protective sheet is wrapped about said prism and corner support members thereby defining a wrapped unit; and further including a rectangular tubular sleeve adapted to slide downwardly about said prism after removal of said protective sheet and corner support members such that rectangular side walls of the sleeve are in opposed adjacent relationship with side walls of the prism, said sleeve having a removable panel in a first side wall, such that removal of said removable panel exposes said tower and provides display of a ready access to individual packaged reams.

4. An assembly according to claim 3, wherein said flexible protective sheet is transparent.

5. An assembly according to claim 4, wherein said first and second stack units each contain 4 to 6 layers of packaged reams, said tower comprises at least two first stack units and at least two second stack units, and each packaged ream comprises said paper sheets wrapped in a paper wrapping.

6. An assembly according to claim 5, wherein said first and second stack units each container 5 layers of packaged reams, said tower comprises 3 first stack units and 2 second stack units and each packaged ream contains 50 paper sheets.

7. An assembly according to claim 4, further including a rectangular tubular sleeve adapted to slide downwardly about the stacked layers, said sleeve having a removable panel in a front wall, such that removal of said removable panel exposes the stacked layers and permits ready access to individual packaged reams, said flexible protective sheet being transparent.

8. A display assembly of reams of paper sheets for point of distribution display of the reams and ease of access to individual displayed reams comprising:

a plurality of displayed stacked layers of packaged reams in aligned contacting relationship, each packaged ream containing a multiplicity of paper sheets in a paper wrapping, each displayed layer comprising displayed packaged reams in side-by-side relationship, said displayed stacked layers forming a displayed tower of the packaged reams, said displayed tower comprising a plurality of first stack units and a plurality of second stack units of said reams, said first and second stack units being in a displayed alternating relationship, said packaged reams of said second stack units being displaced laterally at 90° to said first stack units, said displayed tower defining a rectangular prism, a film of adhesive between at least some contacting upper and lower displayed packaged reams of said layers, said adhesive having a high strength component in a first lateral direction of said film effective to hinder relative horizontal movement of the contacting upper and lower packaged reams having the adhesive film therebetween, and a low strength component in a second direction perpendicular to said lateral direction such that contacting upper and lower packaged reams are readily separated by a displacing force in said second direction, and a rectangular tubular sleeve slidably received on and surrounding said plurality of stacked layers with rectangular walls of the sleeve in opposed adjacent relationship with the stacked layers, said sleeve having a removable panel in a front side wall, such that removal of the removable panel exposes the stacked layers and provides display of and ready access to individual displayed packaged reams.

9. An assembly according to claim 8, wherein said first and second stack units each contain 4 to 6 layers of packaged reams, said tower comprises at least two first stack units and at least two second stack units.

10. An assembly according to claim 8, wherein said first and second stack units each contain 5 layers of packaged reams, said tower comprises 3 first stack units and 2 second stack units and each packaged ream contains 50 paper sheets.

* * * * *